US008356377B2

(12) United States Patent
Harper

(10) Patent No.: US 8,356,377 B2
(45) Date of Patent: Jan. 22, 2013

(54) REINFORCED CUP FOR USE WITH A PIG OR OTHER DOWNHOLE TOOL

(75) Inventor: Thomas M. Harper, Lafayette, LA (US)

(73) Assignee: Full Flow Technologies, LLC, Lafayette, LA (US)

( * ) Notice: Subject to any disclaimer, the term of this patent is extended or adjusted under 35 U.S.C. 154(b) by 325 days.

(21) Appl. No.: 12/777,722

(22) Filed: May 11, 2010

(65) Prior Publication Data

US 2011/0277255 A1 Nov. 17, 2011

(51) Int. Cl.
*B08B 9/04* (2006.01)

(52) U.S. Cl. ..... 15/104.061; 15/104.16; 15/104.31; 166/311; 166/170; 166/173; 285/222.2; 285/222.5

(58) Field of Classification Search ..... 15/104.05, 15/104.061, 104.16, 104.31; 166/339, 349, 166/360, 311, 378, 85.1, 170, 173, 241.1, 166/241.6, 242.1; 285/222.2, 222.4, 222.5
See application file for complete search history.

(56) References Cited

U.S. PATENT DOCUMENTS 1,547,440 A * 7/1925 Penn ..... 15/104.061
2,723,721 A * 11/1955 Corsette ..... 277/341
2,868,298 A * 1/1959 Gist ..... 166/173
3,666,013 A * 5/1972 Saadeh ..... 166/241.1
3,864,203 A * 2/1975 Marzocchi ..... 523/203
4,254,962 A * 3/1981 Blackwell ..... 277/335
4,317,407 A * 3/1982 Blackwell ..... 92/241
4,424,865 A * 1/1984 Payton, Jr. ..... 166/302
4,480,843 A * 11/1984 Springer et al. ..... 277/343
5,295,279 A * 3/1994 Cooper ..... 15/104.061
5,579,839 A * 12/1996 Culpepper ..... 166/118
6,347,667 B1 * 2/2002 Howlett et al. ..... 166/311
6,371,207 B1 * 4/2002 Reynolds ..... 166/312
7,178,588 B2 2/2007 Harper et al.
7,357,177 B2 * 4/2008 Garwood et al. ..... 166/202
7,404,436 B2 * 7/2008 Booth ..... 166/173
7,717,168 B2 * 5/2010 Williams et al. ..... 166/84.1
7,735,552 B2 * 6/2010 Xu ..... 166/202
7,959,155 B2 * 6/2011 Templeton et al. ..... 277/335
2003/0098153 A1 * 5/2003 Serafin ..... 166/202
2004/0242095 A1 * 12/2004 Prakash ..... 442/19
2005/0098313 A1 * 5/2005 Atkins et al. ..... 166/202
2005/0183856 A1 * 8/2005 Williams ..... 166/84.3

* cited by examiner

*Primary Examiner* — Robyn Doan
*Assistant Examiner* — Tatiana Nobrega

(57) ABSTRACT

A reinforced cup for use on downhole devices is disclosed. The reinforced cup is comprised of a cylindrical metal sleeve. Surrounding the outer circumferential surface of the metal sleeve is a flexible mesh cage comprised of a plurality of woven wire strands. A resilient cover is formed around the metal sleeve and flexible mesh fabric are encased by the resilient cover. The flexible mesh cage serves to reinforce the resilient cover.

15 Claims, 5 Drawing Sheets

REINFORCED CUP FOR USE WITH A PIG OR OTHER DOWNHOLE TOOL

FIELD OF INVENTION

The present invention relates to cups for downhole devices and, more particularly, relates to a reinforced flexible cup for use in conjunction with a pig or other devices that are inserted through the interior of a pipeline or pipe string.

BACKGROUND

The drilling or production of oil and gas requires strings of pipe to be positioned in a borehole. The strings of pipe may extend both horizontally and vertically and they may be thousands of feet in length. A coil tubing string is sometimes inserted through the length of these pipe strings for use in clearing or cleaning the interior of these pipe strings. A "pig" may be placed at the end of the coil tubing prior to its insertion into the pipe string to assist in such clearing and cleaning. The pig may be placed on the end of jointed pipe or snubbing unit, or on strings of polymer or composite pipe to achieve the same result.

The pig used in conjunction with the coil tubing string is typically provided with a plurality of resilient cups or rings around its perimeter. These cups contact the interior wall surface of the pipe string when the pig is moved through the pipe string by the tubing string. These resilient cups are often made of rubber, polyurethane or other type of polymer material. Because the resilient cups are subjected to high temperatures, high pressures and abrasion as the pig is moved through the pipe string, these cups often wear, breakdown or become deformed.

SUMMARY OF INVENTION

Applicant provides a reinforced cup which serves to substantially reduce the wear, breakdown and deformation when such cups are adapted for use with a downhole tool. While the cups may be adapted for use with any downhole tool and they are thought to particularly useful when they are adapted for use with a pig and particularly a pig used in conjunction with coil tubing strings.

The reinforced cup is comprised of a cylindrical sleeve having a flexible mesh fabric or cage that extends around the outer circumferential surface of the cylindrical sleeve. The flexible mesh cage is comprised of a weave of wire strands that is attached to the sleeve. The outer periphery of the cylindrical sleeve and the surrounding flexible mesh cage are encased by a resilient cover.

The metal strands used to create the weave of wire strands for the mesh cage may be comprised of a single wire strand or made of woven, braded or twisted wire strands. Any metal wire strand of suitable strength and flexibility might be utilized of the mesh cage. The weave of strands for the mesh cage may also be comprised of wire strands made from a suitable polymer material such as an aramid fiber such as wire strands made of Kavlar® manufactured by Dupont.

The resilient cover may be comprised of any suitable resilient material such as rubber, rubber compounds, plastic or polymer material such as polyurethane, polypropylene or polyethylene materials. The cylindrical sleeve may be constructed of any suitable material such as stainless steel though other materials such as high strength polymers might also be utilized.

DESCRIPTION OF THE EMBODIMENT

Figure 1:
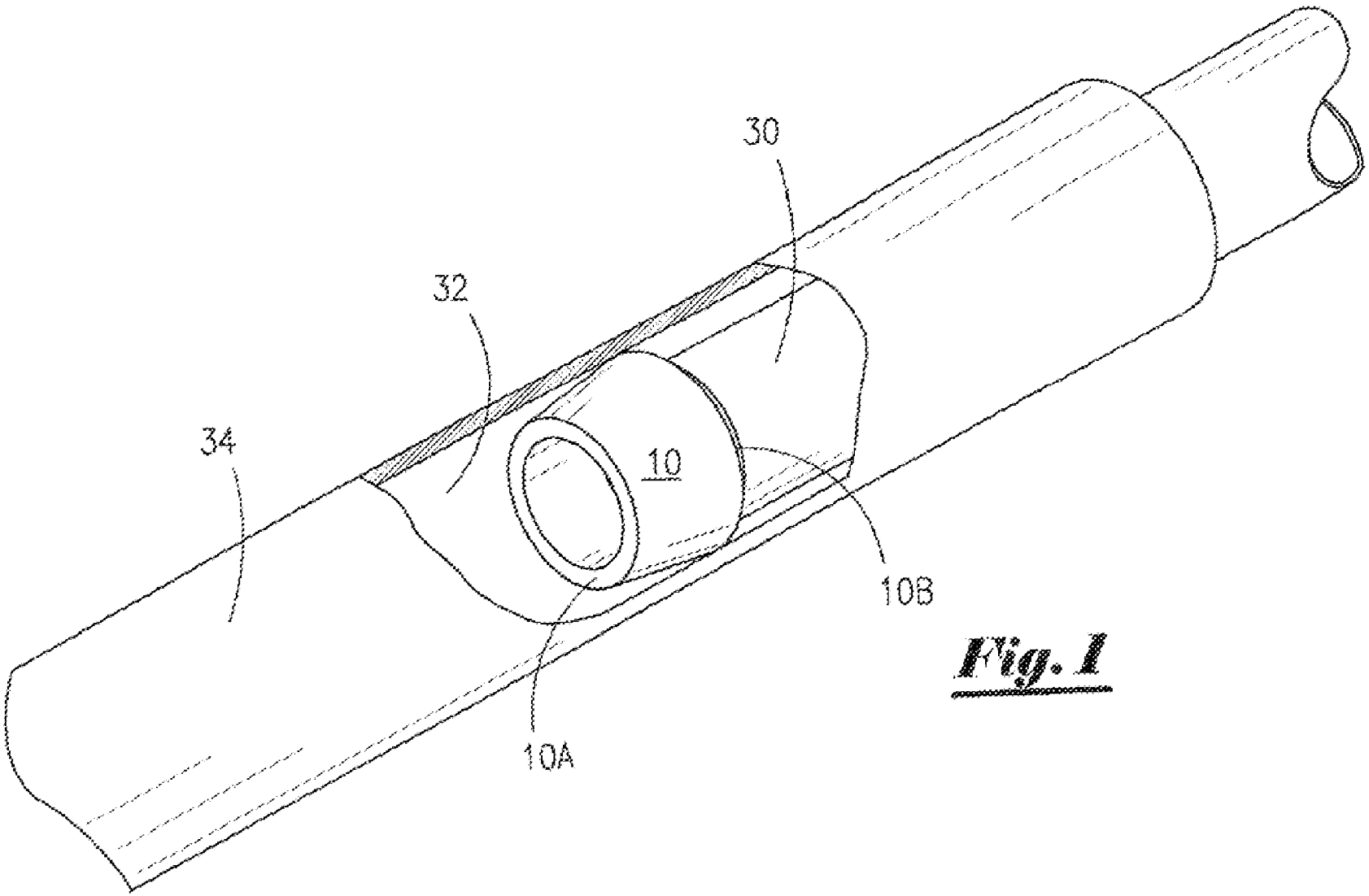
FIG. 1 is a perspective cutaway view of the reinforced cup of the present invention positioned on a pipeline pig within a pipeline.

FIG. 1 shows a perspective cutaway view of the reinforced cup (10) of the present invention in use within a pipeline. The cup (10) is positioned in the interior (32) of a pipeline (34) on a downhole tool (30) such as pig for swabbing the pipeline. The reinforced cup (10) has a leading end or base (10A) and a trailing end (10B) for fitting the cup (10) to a downhole tool.

Figure 2:
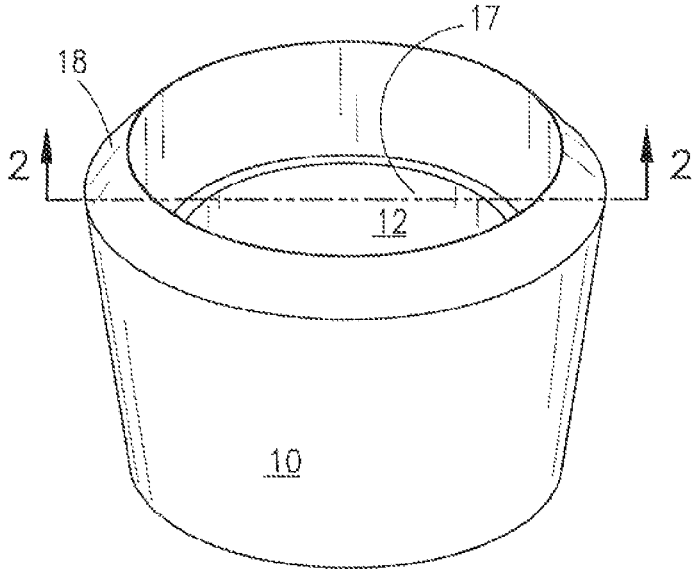
FIG. 2 is a perspective view of the reinforced cup shown in FIG. 1.
Figure 3:
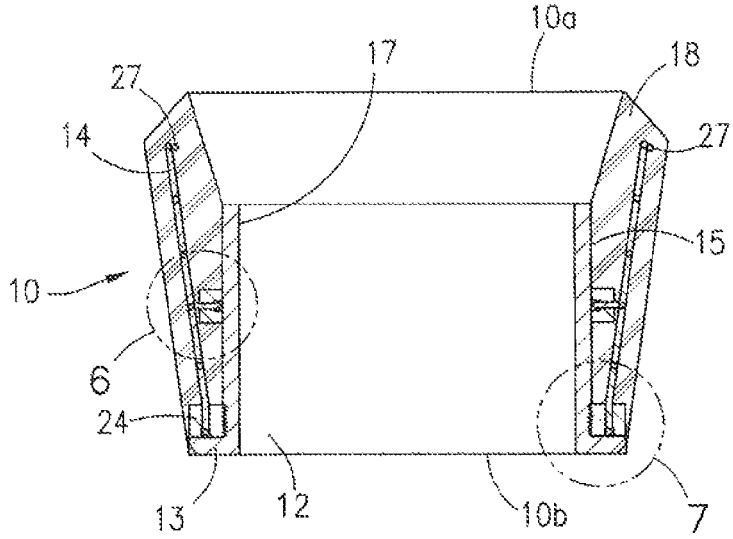
FIG. 3 is a cross-section view of the reinforced cup shown in FIG. 2.

The reinforced cup (10), shown in a perspective view in FIG. 2 and in cross-section in FIG. 3, is comprised of a longitudinally extending hollow cylindrical metal sleeve (12) having an interior surface (17) and an exterior surface (15) that is encased by a resilient cover (18). The cylindrical sleeve (12) is provided with integral protruding ring or flange (13) at the leading end (10A) which serves as a bumper for the cup (10) to prevent breakdown of the cover (18) as the cup (10) is pulled through the pipeline.

Figure 4:
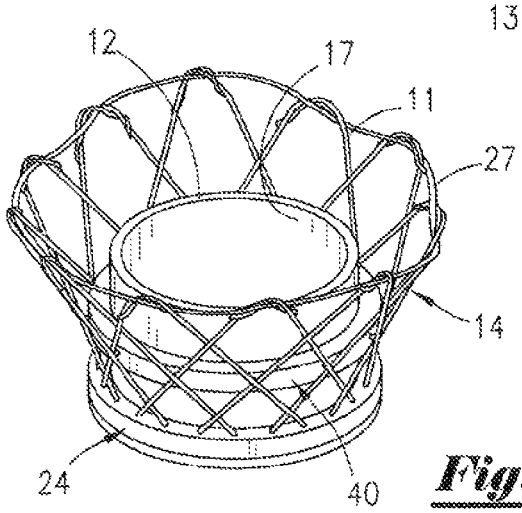
FIG. 4 is a perspective view of the reinforcement cage and sleeve of the reinforced cup shown in FIG. 2 and FIG. 3.

As shown in FIGS. 3-4, the sleeve (12) is adapted to receive a base ring (24) which fits around the exterior surface (15) of the sleeve (12). Threads (20) cut longitudinally along the outer surface (15) of the sleeve (12) that extend distally from the flange (13) correspond with threads (26) cut longitudinally on the interior surface of the base ring (24). The threads (20) on the sleeve (12) allow the base ring (24) to be threaded onto the sleeve (12) and positioned longitudinally on the sleeve (12) against the top (22) of the sleeve flange (13).

Figure 5:
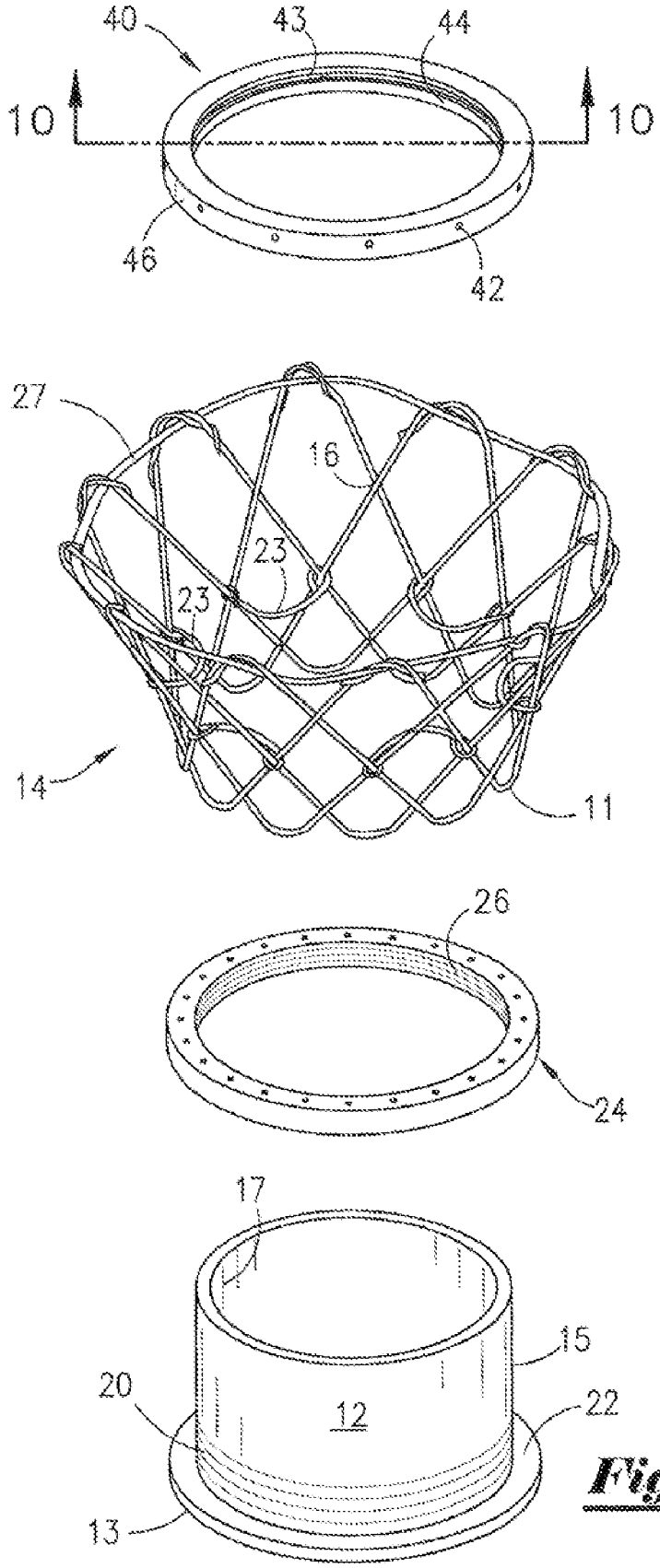
FIG. 5 is an arrayed perspective view of the reinforcement cage, reinforcement rings, and sleeve components of the reinforced cup shown in FIG. 1.
Figure 8:
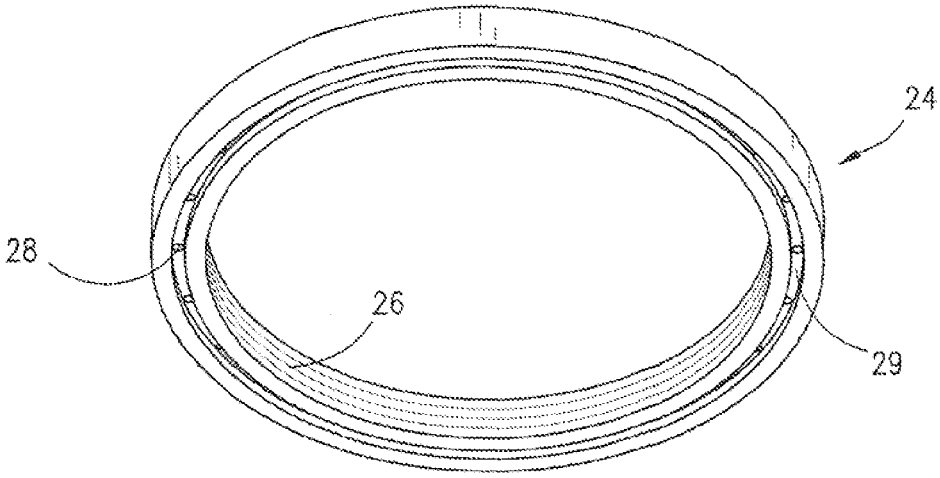
FIG. 8 is a bottom perspective view of the base ring of the reinforced cup of FIG. 2.
Figure 9:
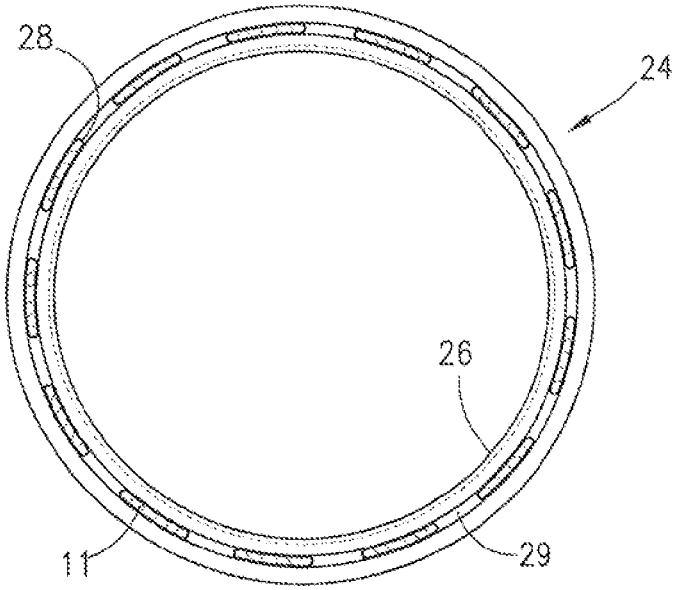
FIG. 9 is a bottom view of the base ring of the reinforced cup of FIG. 2.

As seen in FIGS. 8 and 9, the bottom (25) of the base ring (24) has a circular groove (29) and a plurality of holes (28) that are located in the groove (29) and which extend through and along the longitudinal axis of the base ring (24). The groove (29) and the holes (28) are configured to receive a first reinforcing wire (11) shown in FIGS. 4 and 5 that is laced and overlaid at wire intersections 16) to form a weave of wire strands (u) to create a conical, flexible, reinforcement mesh cage (14) that extends outward from the base ring (24). The flexible, conically shaped mesh cage (14) serves to reinforce the cover (18) to reduce wear, breakdown, and deformation of the resilient cover (18) and thus the cup (10) when the cup (10) is adapted for use with a downhole tool.

Figure 7:
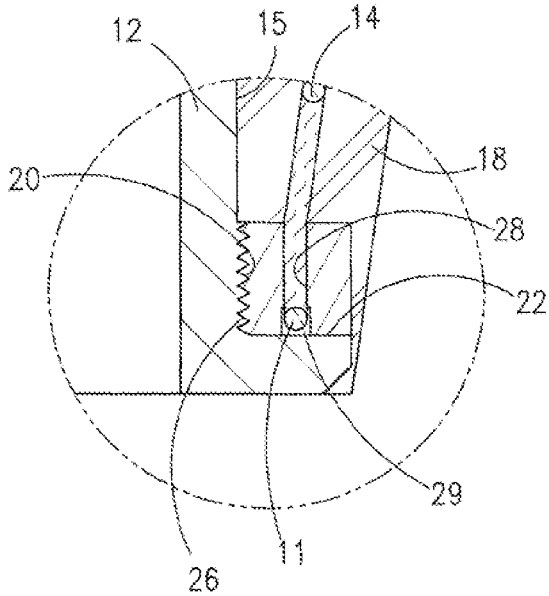
FIG. 7 is a detailed cross-section view of the leading end of the reinforced cup shown in FIG. 3.

As shown in FIG. 4 and FIG. 7 , an enlarged detail view of the area designated (7) on FIG. 3, the base ring (24) fixes the flexible mesh cage (14) to the cylindrical sleeve (12) when base ring (24) is positioned against the top (22) of the sleeve flange (13). However, the wire cage (14) may be attached directly to the base ring (24) or directly to the top flange surface (22) of the sleeve (12) by weldments or other suitable means.

Figure 6:
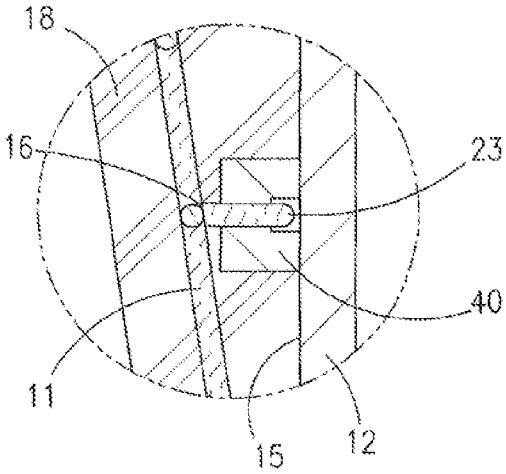
FIG. 6 is a detailed cross-section view of the reinforced cup shown in FIG. 3.
Figure 10:
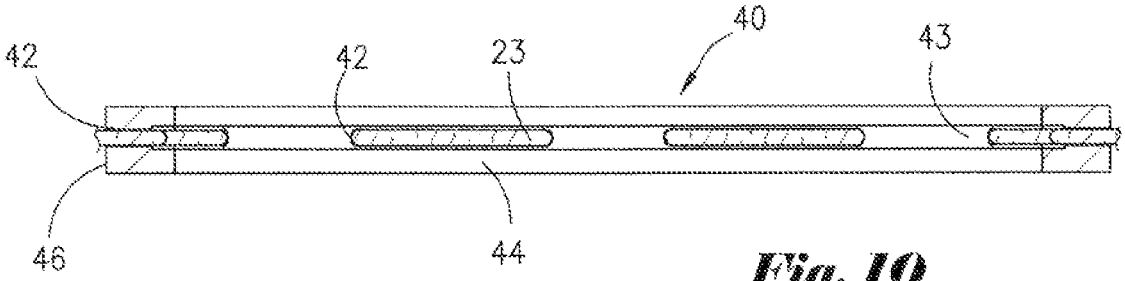
FIG. 10 is a cross-section view of the lateral reinforcement ring of the reinforced cup of FIG. 2.

A second ring or lateral reinforcement ring (40) having an inner periphery (44) and an outer periphery (46) may he provided around the outer surface (15) of the sleeve (12) to further support the wire cage (14). The second ring (40) as, shown in FIGS. 3, 5, and 10, and in FIG. 6, an enlarged detail view of the area designated (6) on FIG. 3, serves to prevent compression of the conical wire cage (14) during placement or molding of the resilient cover (18). The outer periphery (46) of ring (40) has a circular groove (43) and a plurality of holes (42) that are located in the groove (43) which extend through the ring (40).

The holes (42) and groove (43) of ring (40) are configured to receive a plurality of second reinforcing wires (23) that extend outward in a radial direction from the exterior surface (15) of the sleeve (12). The wires (23) are laced over and twisted around the wire (11) of the mesh cage (14). The ring (40) and wire (23) provides lateral reinforcement to the flexible mesh cage (14).

The flexible mesh cage (14) may be provided with a third reinforcing wire (27) that forms a hoop interwoven with the wire (11) around the mesh cage (14) at the end proximal to the trialing end (10A) of the cup (10). This hoop serves to further reinforce the cup (10) and to prevent slippage or tearing of the cover (18) away from the mesh cage (14).

The reinforcing wire (11), (23) and (27) may be made of woven, twisted or braded wire strands or may be a wire of a single strand. Wire (11), (23) and (27) is made of a metal of suitable strength and flexibility such as stainless steel. However, reinforcing wire (11) and (23) comprised of a strand or strands of a suitable polymer material such wire made from an aramid fiber could also be utilized. Wire comprised of a strand or strands of Kevlar® as manufactured by Dupont is thought to be suitable for the reinforcement wire (11) and (23). The wire (11), (23) and (27) of the mesh cage (14) could also be made from strands of a combination of polymer material and metal.

The resilient cover (18) may be molded from any suitable moldable resilient material such as plastic, rubber, rubber compounds, or polymer material such as polyurethane, polypropylene or polyethylene. It is thought that a moldable polyurethane material will be utilized for the cover (18) of the cup (10). Such molding may be accomplished by conventional means so that at the conclusion of the molding process, the cover (18) will encase the sleeve (12) and the reinforcement mesh cage (14).

It is thought that the cylindrical sleeve (12) of the cup (10) will be constructed of a suitable metal such as stainless steel. Nonetheless, other metals and materials such as a high strength and high heat resistant polymer material might also be utilized.

As shown in FIG. 1, the cup (10) as described herein may be fitted to a downhole tool (30) positioned within the interior (32) of a pipeline (34). The dimensions of the cup (10) may be adapted to a desired size for use with pipelines of various sizes and interior diameters.

It is thought that the reinforced flexible cup (10), for use in conjunction with a downhole tool (30) such as a pipeline pig or with other downhole devices, presented herein will be understood from the foregoing description. It is also thought that it will be evident that various changes may be made in the form, construction and arrangement of the parts of the cup (10), without departing from the spirit and scope of the invention or sacrificing its material advantages. The form described herein is intended to be merely an example embodiment of the invention.

I claim:

1. A reinforced cup for use on downhole devices, comprising:

(a) a cylindrical sleeve, said sleeve having an outer circumferential surface and a leading end;

(b) a protruding flange ring at said leading end of said sleeve;

(c) a segment of cut threading on the outer surface of said sleeve, said segment of cut threading extending distally from said flange ring at said leading end of said sleeve;

(d) a first reinforcement support ring threadably mounted to said sleeve by said segment of cut threading;

(e) a weave of wire strands attached to said first reinforcement ring, said weave of wire strands configured to create a flexible reinforcement mesh cage that extends around said outer circumferential surface of said cylindrical sleeve; and (f) a resilient cover, said resilient cover encasing said cylindrical sleeve and said flexible mesh cage.

2. The reinforced cup as recited in claim 1, further comprising:

(a) a second reinforcement support ring mounted to said sleeve, said second reinforcement support ring positioned on said sleeve at a desired position distal from said flange ring on said leading end of said sleeve; and (b) reinforcing wire strands attached to said second reinforcement support ring, said reinforcing wire strands laced to said weave of wire strands forming said flexible mesh cage.

3. The reinforced cup as recited in claim 2, wherein said first reinforcement ring has a plurality of holes for receiving and attachment of said weave of wire strands forming said flexible reinforcement mesh cage.

4. The reinforced cup as recited in claim 3, wherein said second reinforcement support ring has a plurality of holes for receiving and attachment of said reinforcing wire strands laced to said weave of wire strands forming said flexible mesh cage.

5. The reinforced cup as recited in claim 4, wherein said weave of wire strands creating said flexible mesh cage is comprised of metal wire strands.

6. The reinforced cup as recited in claim 5, wherein said wire strands are twisted wire strands.

7. The reinforced cup as recited in claim 5, wherein said wire strands are braded wire strands.

8. The reinforced cup as recited in claim 5, wherein said wire strands are woven wire strands.

9. The reinforced cup as recited in claim 4, wherein said weave of wire strands creating said flexible mesh cage are polymer strands.

10. The reinforced cup as recited in claim 4 wherein said resilient cover is comprised of a moldable polymer material selected from the group consisting of polyurethane, polypropylene, and polyethylene.

11. The reinforced cup as recited in claim 4 wherein said resilient cover is comprised of rubber.

12. A reinforced cup for use on downhole devices, comprising:

(a) a longitudinally extending cylindrical sleeve, said sleeve having an outer circumferential surface and a leading end;

(b) a protruding flange ring at said leading end of said cylindrical sleeve;

(c) a segment of cut threading extending longitudinally along the outer surface of said cylindrical sleeve, said segment of cut threading extending distally from said flange ring at said leading end of said cylindrical sleeve;

(d) a first longitudinally extending reinforcement support ring threadably mounted to said cylindrical sleeve at said segment of cut threading, said first support ring having a plurality of holes extending longitudinally through first support ring;

(e) a weave of wire strands laced through said plurality of longitudinally extending holes in said first support ring, said weave of wire strands configured to create a conical, flexible reinforcement mesh cage that extends around said outer circumferential surface of said cylindrical sleeve;

(f) a second reinforcement support ring mounted to said sleeve, said second reinforcement support ring positioned on said sleeve at a desired position distal from said flange ring at said leading end of said sleeve, said second reinforcement ring having a plurality of holes extending radially through said second reinforcement support ring;

(g) reinforcing wire strands inserted through said plurality of radially extending holes in said second reinforcement support ring, said reinforcing wire strands laced to said weave of wire strands forming conical, flexible reinforcement mesh cage; and (h) a resilient cover formed from a moldable polymer material, said polymer cover extending distally from said flange ring at said leading end of said cylindrical sleeve and encasing said outer surface of said cylindrical sleeve and said conical, flexible reinforcement mesh cage.

13. The reinforced cup as recited in claim 12, wherein said moldable polymer material is selected from the group consisting of polyurethane, polypropylene, and polyethylene.

14. The reinforced cup as recited in claim 13, wherein said weave of wire strands creating said flexible mesh cage are metal wire strands.

15. The reinforced cup as recited in claim 13, wherein said weave of wire strands creating said flexible mesh cage are polymer strands.

* * * * *